United States Patent [19]

Drucker, Jr.

[11] Patent Number: 4,942,841

[45] Date of Patent: Jul. 24, 1990

[54] VEHICLE SERVICE REMINDER DISPLAY

[76] Inventor: Jack L. Drucker, Jr., 2653 Halm Ave., Los Angeles, Calif. 90034

[21] Appl. No.: 366,471

[22] Filed: Jun. 15, 1989

[51] Int. Cl.[5] ..... G09F 11/12

[52] U.S. Cl. ..... 116/317; 116/309; 116/316; 235/110; 235/114; 235/117 A

[58] Field of Search ..... 40/503, 594, 643; 116/223, 309, 311, 312, 315, 316, 317; 235/110, 114, 117 A, 122

[56] References Cited

U.S. PATENT DOCUMENTS

| | | | |
|---|---|---|---|
| 1,583,942 | 5/1926 | Travis | 40/647 |
| 2,349,452 | 5/1944 | Musolino | 235/117 A |
| 2,421,513 | 6/1947 | Lofstrom | 235/117 A |
| 2,931,657 | 4/1960 | Lewis | 40/503 |
| 3,434,454 | 3/1969 | Ashton | 116/317 |
| 3,776,177 | 12/1973 | Bryant et al. | 116/311 |
| 4,069,606 | 1/1978 | Shevin et al. | 40/643 |
| 4,133,289 | 1/1979 | Beattie | 116/309 |

FOREIGN PATENT DOCUMENTS

| | | | |
|---|---|---|---|
| 1286556 | 1/1962 | France | 116/317 |

*Primary Examiner*—William A. Cuchlinski, Jr.
*Assistant Examiner*—W. Morris Worth
*Attorney, Agent, or Firm*—Philip D. Junkins

[57] ABSTRACT

An automotive vehicle service reminder display device comprised basically of: a shallow box or case having a principal rectangular face wall, side walls and end walls within which are mounted rows of indicia wheels organized between divider walls; and a case closure plate for maintaining the indicia wheels in operative alignment. The principal face wall of the device includes a number of viewing ports through which indicia information and data imprinted on the periphery of the wheels may be read. The indicia wheels are individually rotatable through the viewing ports by finger tip pressure and movement thereof to set appropriate data and information under service item nomenclature printed on the outside of the face wall adjacent each viewing port.

5 Claims, 1 Drawing Sheet

VEHICLE SERVICE REMINDER DISPLAY

BACKGROUND OF THE INVENTION p 1. Field of the Invention

The present invention relates to automotive vehicle service and operation information and data. More particularly, the invention relates to devices for displaying vehicle service and operation reminder information and data to the operator of a vehicle.

2. Description of the Prior Art

Since the introduction of automotive Vehicles there has been a need on the part of vehicle operators to have means for reminding the operator of important vehicle service information and record data. As early as 1926 U.S. Pat. No. 1,583,942 was granted to P. M. Travis for a holder, adapted to be mounted of the instrument board of automobile, for cards bearing indicia relative to mileage, battery test and oil Change data. In U.S. Pat. No. 4,069,606 granted to J. R. Shevin et al in 1978, the patentees also disclose a holder for removably retaining a card or strip containing automotive vehicle service information, particularly written notation of dates of oil change and lubrication, oil brands, etc. The Shevin et al card holder may be attached to the dash board of a vehicle by two-sided pressure sensitive tape affixed to the rear of the card holder.

When a vehicle is serviced as in lubricating, changing oil, etc., the information is important to the operator so that he or she knows when further servicing is necessary. The above mentioned vehicle service information devices and other information card holders for automotive vehicles require that various card forms be periodically supplied with revised written service information. One of the objects of the present invention is to provide a simple and inexpensive device for displaying vehicle service information and data which can be readily changed by finger rotation of a group of indicia-bearing wheels mounted within the device.

It is another object of the invention to provide an automotive vehicle service and data display device including groupings of rotatable indicia-bearing wheels which display service information and data.

It is a further object of the invention to provide an automotive vehicle service and data display device including indicia-bearing wheels which may be rotated by finger action to change the displayed service information and data.

It is a further object of the invention to provide a vehicle service information and data display device which can be easily mounted for ready viewing by the vehicle operator.

Other objects and advantages of the invention will be apparent from the follow summary and detailed descriptions of the invention, taken together with the accompanying drawing figures.

SUMMARY OF THE INVENTION

The present invention relates to an improved vehicle service reminder display device. The display device is comprised basically of: a shallow box or case having a principal face wall, side walls and end walls within which are mounted groups of indicia wheels (organized and grouped within the case by divider walls and pins); and a case closure plate for maintaining the indicia wheels in operative alignment. The principal face wall of the device includes a number of viewing ports through which indicia information On the periphery of the indicia wheels may be read. The indicia wheels are rotatable through the viewing ports by finger tip movement thereof to set appropriate data and number information and data under service item headings or titles printed on the face wall adjacent each viewing port. After placement of the indicia wheels in the display box or case, the case closure plate is permanently affixed to the case. The closure plate forms a back wall to the case and may carry with it on its outer surface means to mount the service reminder display device to an appropriate surface of the vehicle's dash or instrument board (as by a pressure sensitive adhesive) or to the sun visor above and in front of the vehicle operator (as by a visor clip).

BRIEF DESCRIPTION OF THE DRAWING FIGURES

Figure 4:
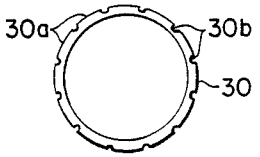
FIG. 4 is a side view of one of the axle-free indicia wheels utilized within the display device of the invention.
Figure 4A:
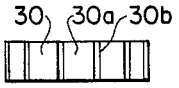
Figure 4B:
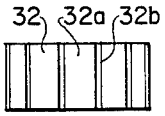

FIG. **4*a* is an edge view of one of the axle-free indicia wheels of relatively narrow size upon which a sequence of numbers may be imprinted for selective viewing through an associated indicia viewing port; and FIG. 4*b*** is an edge view of one of the axle-free indicia wheels of relatively wider size upon which works or other service information may be imprinted for selective viewing through an associated viewing port.

DETAILED DESCRIPTION OF A PREFERRED EMBODIMENT

Figure 1:
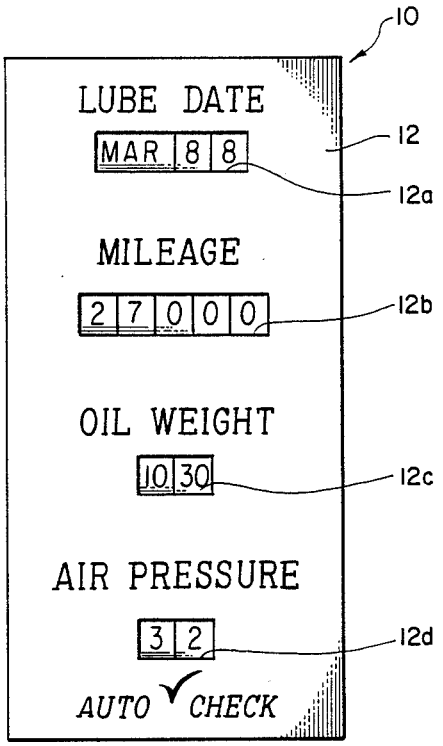
FIG. 1 is a front view of the vehicle service reminder display device of the invention showing on its display face a number of vehicle service items and indicia viewing ports displaying information and date related to each service item.
Figure 2:
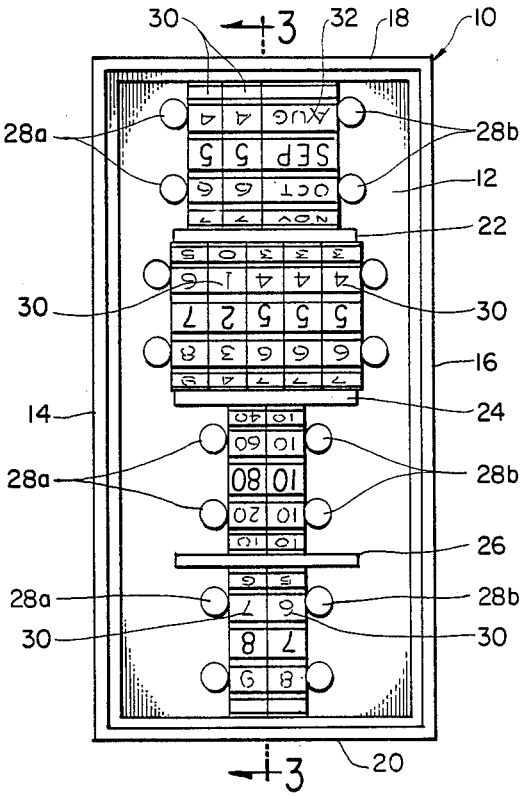
FIG. 2 is a rear view of the open case forming the vehicle service reminder device of FIG. 1 with the groups of indicia wheels in place in association with their respective viewing ports.
Figure 3:
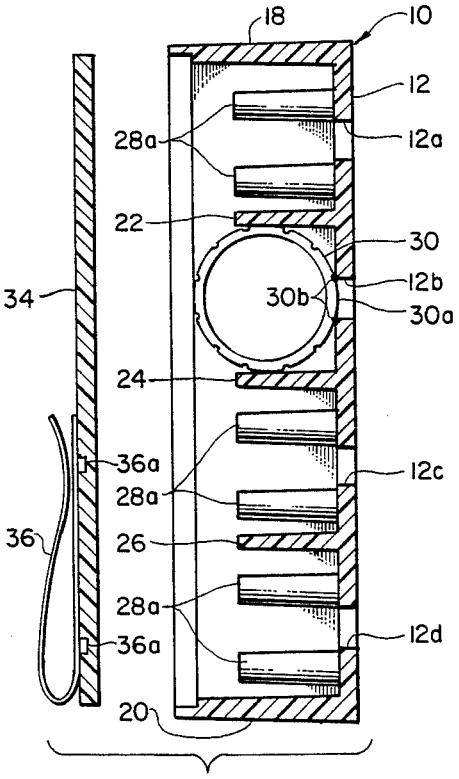
FIG. 3 is a side sectional view of the vehicle service reminder display device of the invention showing the position of one of the indicia wheels within the case and showing the back closure plate removed from the case but in closure alignment therewith.

Referring initially to FIG. 1 of the drawings there is shown the principal face wall 12 of the vehicle service reminder display device 10 of the invention. The face wall includes a series of indicia viewing ports or openings **12*a*, 12*b*, 12*c* and 12*d* with the accompanying exemplary and illustrative service information titles "Lube Gate," "Mileage," "Oil Weight" and "Air pressure," respectively. The service reminder device 10, in its outward appearance and structure, is comprised of two major components, i.e., a shallow box or case consisting of the face wall 12, side walls 14 and 16 and end walls 18 and 20 (see FIGS. 2 and 3) and a back closure plate 34. The shallow box or case of service reminder device 10 may be molded of any of a number of well known plastic molding materials and in any of many colors. The box or case of device 10 is also molded with a series of divider wall extending from the inside of the face wall 12 toward the closing position of closure plate 34, i.e., top divider wall 22, middle divider wall 24 and bottom divider wall 26. These divider walls, along with end walls 18 and 20, support and position in aligned rows the series of indicia wheels 30 and 32 in alignment with the indicia viewing ports 12a–12d. The indicia wheels are further maintained in their respective rows by pairs of end posts 28a and 28b extending from the inside of the face wall 12 toward the closing position of closure plate 34. It is to be noted that the divider walls 22, 24 and 26 and the posts 28a and 28b are tapered slightly from their points of attachment to face wall 12** to their outermost extent to assist in molding the case, divider walls and posts as a single unit.

The indicia wheels 30 and 32, as shown in FIGS. 4, 4a and 4b, may be of two or more widths. The narrowest wheels (FIG. 4a) may be employed in their surface areas 30a for the display of one or two digit numbers whereas the wider wheels 32 such as illustrated in FIG. 4b) may be employed in their surface areas 32a for the display of words or word abbreviations. Each indicia display area 30a or 32a on the indicia wheels 30 or 32 is separated and defined by detents 80b and 32b respectively. These detents are also utilized to engage the inside edges of the indicia viewing ports 12a–12d, as particularly shown in FIG. 3. Thereby the indicia wheels 30 and 32 are maintained in a given indicia display position (through a view port) until lightly depressed and moved by the finger of an individual setting or resetting the indicia wheels to display pertinent automobile service information and data. As shown in FIGS. S and 4, the indicia wheels 30 and 32 are preferably of ring shape configuration and are axleless. Other indicia wheel configurations may be utilized in the construction of the vehicle service reminder display device 10 of the invention.

The closure plate for the display device is a flat rectangular member (see FIG. 3 for an edge view of the closure plate) which is permanently affixed to the box or case (at the perimeter of side walls 14 and 16 and end walls 18 and 20) after placement of the appropriate number of indicia wheels 30 and 32 therein (with appropriate indicia imprinted thereon) in alignment between the divider walls 22, 24 and 26 and end walls 18 and 20, and end posts 28a and 28b. With the closure plate 34 in its seated and affixed position with respect to the display box or case 10, all of the contained indicia wheels 30 and 32 are held in position for appropriate numerical and word display settings corresponding to the automotive service information and history items named on the face of the device.

The closure plate 34 may be provided with appropriate means for mounting the service reminder display device to a surface of the vehicle's dash or instrument board as by pressure sensitive adhesive strip material affixed to the outer surface of the closure plate. Alternatively, the closure plate 34 (as shown in FIG. 8) may include a visor spring clip 36 for affixing the service reminder display device 10 to the top of an automobile sun visor for viewing periodically when the visor is turned down by the vehicle operator. The visor clip 36 may be affixed to closure plate 34 by appropriate clip attachment means 36a.

From the above description of the present invention it will be apparent that there has been provided a useful and convenient vehicle service reminder display device which can be easily updated to display current service information. While certain novel features of this invention have been shown and described and are printed out in the annexed claims, it will be understood that modifications and changes in the form and detail of the device illustrated and in its assembly and operation can be made by those skilled in the art without departing from the spirit of the invention which is to be limited only by the scope of the following claims.

What is claimed is:

1. An automotive vehicle service reminder display device comprising in combination:

(a) a shallow case consisting of a rectangular face wall having a series of indicia viewing ports, elongated side walls and end walls enclosing a central chamber for receiving indicia wheels, said case containing at least two divider walls extending from the inside surface of said face wall is parallel alignment with said end walls, said indicia viewing ports being centrally aligned between said divider walls and between said divider walls and the end walls of said case and said indicia viewing ports having associated therewith on the outside of said face wall vehicle service nomenclature;

(b) a plurality of indicia wheels of like diameter positioned in rows of two or more of said wheels between the divider walls and between the divider walls and the end walls of said case, said wheels each having on their periphery an appular series of like imprintable indicia display surface areas said indicia display areas being defined by detent grooves which interlock with the edges of said indicia viewing ports;

(c) means within said case for maintaining the rows of indicia wheels between said divider walls and between said divider walls and said end walls;

(d) closure means for said case mounted to the outer edges of said side walls and said end walls for closing said case and for maintaining said indicia wheels therein with pairs of the detent grooves of each of said wheels in contact with the edges of said indicia viewing ports; and (e) indicia representing a variety of vehicle service information and data imprinted on the display surface areas of said indicia wheels, said wheels being rotatable under finger pressure through said viewing ports to align appropriate indicia information and data with said ports as displayed service information and data.

2. An automotive vehicle service reminder display device as claimed in claim 1 wherein said closure means includes on its outer surface means for affixing said display device to the dash board or visor of an automotive vehicle.

3. An automotive vehicle service reminder display device as claimed in claim 1 wherein the indicia wheels are axleless rings and are depressible through the viewing ports for rotation within the case whereby appropriate indicia information and data is displayed through said ports.

4. An automotive vehicle service reminder display device as claimed in claim 1 wherein the means within said case for maintaining the rows of indicia wheels in alignment between the divider walls and between the divider walls and the end walls of the case are posts molded to the inside surface of the face wall and extending therefrom at the end of each row of said wheels toward the closure means.

5. An automotive vehicle service reminder display device as claimed in claim 1 wherein the indicia wheels are axleless rings of varying thickness to accommodate on their display surface areas numbers and words as the imprinted and displayed information and data.

* * * * *